United States Patent [19]

Mudd

[11] Patent Number: 4,936,219

[45] Date of Patent: Jun. 26, 1990

[54] FIN PROTECTION DEVICE

[75] Inventor: Richard M. Mudd, Baltimore, Md.

[73] Assignee: The United States of America as represented by the Secretary of the Army, Washington, D.C.

[21] Appl. No.: 392,678

[22] Filed: Aug. 10, 1989

[51] Int. Cl.[5] ..... F42B 14/08

[52] U.S. Cl. ..... 102/520

[58] Field of Search ..... 102/520, 521, 522, 523

[56] References Cited

U.S. PATENT DOCUMENTS

| | | | |
|---|---|---|---|
| 2,998,780 | 9/1961 | Anspacher et al. | 102/523 |
| 3,186,342 | 6/1965 | Hancock | 102/523 |
| 3,961,580 | 6/1976 | Burnett et al. | 102/520 |
| 4,408,538 | 10/1983 | Deffayet et al. | 102/522 |
| 4,434,718 | 3/1984 | Kopsch et al. | 102/522 |
| 4,658,728 | 4/1987 | Amos et al. | 102/501 |
| 4,709,638 | 12/1987 | Broden et al. | 102/522 |

FOREIGN PATENT DOCUMENTS

| | | | |
|---|---|---|---|
| 496879 | 8/1919 | France | 102/522 |
| 2420116 | 10/1979 | France | 102/520 |

*Primary Examiner*—Charles T. Jordan
*Assistant Examiner*—Michael J. Carone
*Attorney, Agent, or Firm*—Saul Elbaum; Paul S. Clohan

[57] ABSTRACT

A device for protecting the fins of a projectile having a cylindrical housing with a closed base, a side wall and an open end, the closed base having a seat for transmitting a portion of the propellant forces used to launch the projectile to the fins, the open end having pivotably attached a number of petal enclosures in the shape of a frustrum of a right circular cone with a contoured surface at one end. A modified sabot retaining ring keeps the petals in a closed position against the projectile. Either a spring, a petal bell or an explosive is used for opening the petals after the projectile exits the muzzle end of a launcher.

11 Claims, 4 Drawing Sheets

FIN PROTECTION DEVICE

RIGHTS OF THE GOVERNMENT

The invention described herein may be manufactured, used and licensed by or for the United States Government for Governmental Purposes without payment to me of any royalty thereon.

BACKGROUND OF THE INVENTION

The present invention relates to projectiles and the protection of their exterior surfaces against interior ballistic destruction or ablation. In particular, but not exclusively, it relates to fin stabilized, kinetic energy projectiles.

Fins have been used for some time in the ordnance field to stabilize projectiles in flight. After the projectile exits the gun tube, aerodynamic spin is induced by canted control surfaces on the fin blades. This spin is needed to stabilize the projectile and reduce yaw. Reducing the total yaw is extremely important in order to maximize terminal ballistic performance on target. Stabilizing the projectile gives a repeatable ballistic trajectory with a tighter dispersion pattern on target and a higher probability of hitting a target at range. For fin stabilized projectiles the loss of fin blades or severe fin ablation will destabilize aeroballistic flight and induce yaw.

Projectile designers are currently concerned with making projectiles longer to increase penetration. Kinetic energy fin stabilized penetrator designs have especially concentrated in this area. These designs have emphasized seating the projectile further back into the case. Longer projectiles have increased weights and use more propellant to give higher energy densities for the penetrator on target. In many instances, the extreme pressures and the heat transfer from the propellant bed ablates control surfaces and breaks fin blades. As these new designs seat the projectiles further back into the propellant bed, the fin blades spend a longer time in these caustic environments. The problem is not eliminated by using separate loading ammunition, as separate loading ammunition has also been known to break fin blades as well as ablate the fin blades. Gases from the burning propellant bed accelerate the propellant bags into the fin blades fracturing them.

Projectiles fired from a gun by means of a propellant charge are also subject to in-bore damage due to high propellant flash temperatures. This is particularly harmful when lightweight stabilizing tail fins of aluminum are used. Attempts have been made to protect the outer surface of such fins by anodizing, but this has not proved effective against thermal erosion or bag damage. Thermally insulating coatings of ceramic type have also been tried but these present adhesion problems and the layer thickness required tends to distort the aerodynamic characteristic of the fins. Heat absorbent coatings such as coatings containing intumescent materials are also known for their thermally protective properties but these too have poor adhesion and also undergo dimensional changes in operation which degrade the aerodynamic performance of a finned projectile.

Another example of a heat absorbent coating is that of an ablative heat shield, i.e., a sacrificial layer of material which is gradually removed by thermally induced processes, e.g., pyrolysis, melting and vaporization. Such heat shields are known for the protection of space vehicles at re-entry to the earth's atmosphere for example and are generally formed from plastics or composites having a fairly high fiber content, and often include intumescent materials. The composites are usually applied to the relevant surface either as a bonded preformed layer or in fluid form by trowelling or casting. Such protective layers are thick and heterogeneous, ablate unevenly and consequently would have the effect of adversely distorting the aerodynamic profile of a precise structure such as the fins of a projectile, both initially and variably during flight. Even if the coating is made relatively thin, sufficient protection is not provided from the damage caused by propellant bags in separate loading ammunition.

OBJECTS AND SUMMARY OF THE INVENTION

It is therefore a primary object of the invention to protect the fins of a fin stabilized projectile from the caustic effects encountered within the ammunition case.

A further object of the invention is to protect the fins from the extreme pressures and temperatures encountered during launch of the projectile.

Another object of the invention is to protect the fins from possible damage caused by gases from burning propellant accelerating the propellant bags into the fin blades on separate loading ammunition.

The present invention provides a cylindrical shell covering the rear and bottom portions of the fins of the projectile. The base of the shell is closed except for a small aperture filled with a powder train for ignition of the tracer in the projectile. The top of the shell has two or more petals which close and cover the front portion of the fins. The petals are held in place by a breakable ring around the portion of the petals in contact with the projectile. After exit from the muzzle, the petals are opened by aerodynamic, mechanical or pyrotechnic means allowing the fin protection device to separate from the fins of the projectile.

DETAILED DESCRIPTION OF THE PREFERRED EMBODIMENTS

Figure 1:
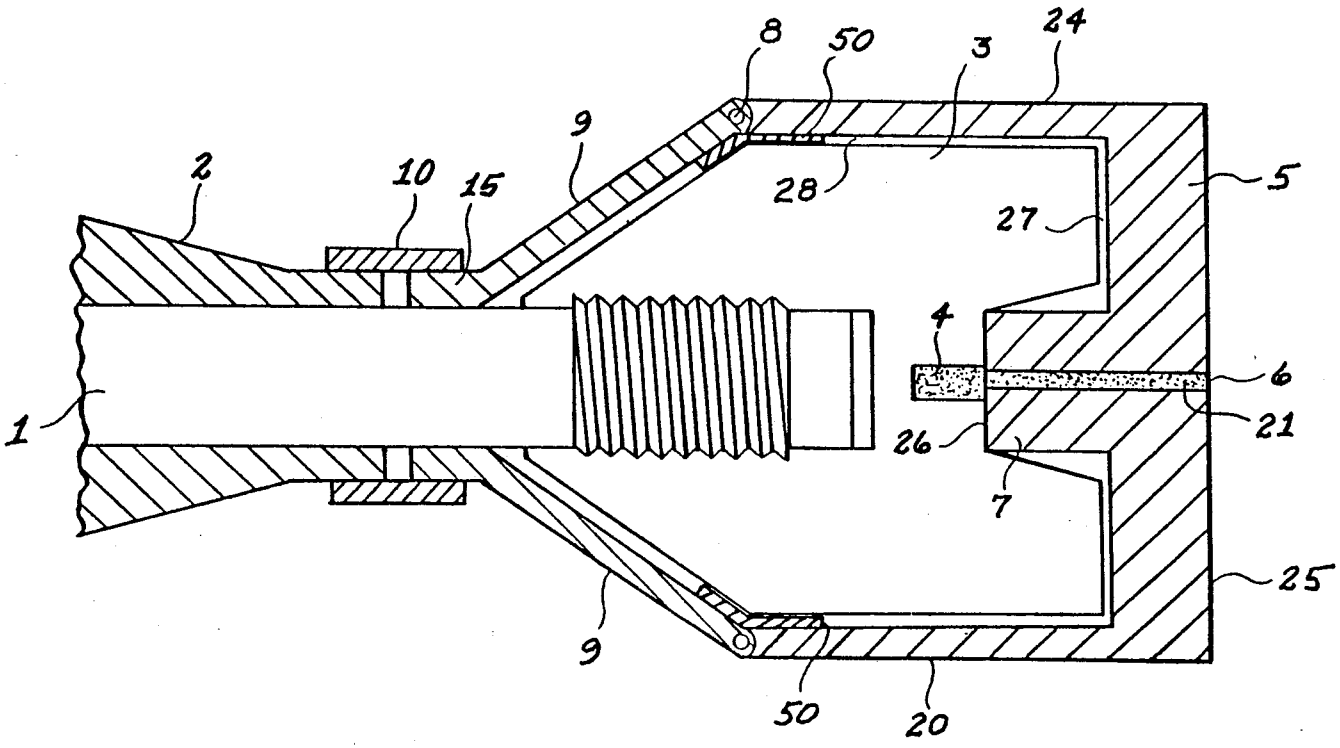
FIG. 1 is a partial cross section of a fin stabilized penetrator having its fins protected by the present invention.

Referring now to FIG. 1, a fin protection device according to the present invention is shown. The fin protection device has four basic components; a protection shell 5, front protection petals 9, a front retaining ring 10, and a petal pivot point 8. Protection shell 5 has a side wall 24, whose thickness is defined by two concentric cylinders, and a base 25. Side wall 24 protects the outer surfaces of fins 3 while base 25 protects the rear surfaces of fins 3. The thickness of side wall 24 and base 25 will depend upon the caliber of the gun and material to be used. Protection shell 5 further has a seat 7, used mainly with boat tailed fin designs, although it could be used with other types of fin designs. The purpose of seat 7 is to transfer most of the launch forces to the fin hub and the penetrator along surface 26. A small gap 27 is provided between the rear surface of fins 3 and base 25 to insure that the initial forces are transferred only to the fin hub and then on to penetrator 1. A small gap 28 is also provided between the outer surface of fins 3 and side wall 24, which not only provides the necessary separation between shell 5 and fins 3 but also tends to reduce any rocking of the protection shell 5 during launch. In this embodiment, the rear portion of fins 3 will not engage base 25; however, seat 7 can also be designed to compress during launch to close gap 27 and engage the fin blades with base 25, in which case the forces would be distributed uniformly on all fin blades with the majority of the force taken up along surface 26. Protection shell 5 also has a small aperture 6 filled with a chemical powder train 21 to provide ignition for tracer 4. Powder train 21 is designed such that tracer 4 ignition starts near gun muzzle exit.

At selected locations on the end of each front petal 9 are tabs connecting front petal 9 to side wall 24. These tabs engage at pivot point 8 via a hole-pin arrangement which allows the front petals 9 to rotate away from fins 3 and penetrator 1. Hinge springs 50 are used at pivot point 8 to provide the rotational energy for front petals 9. The tabs are spaced such that they will fit between two adjacent fin blades.

Front petals 9 are nested down onto penetrator 1 and held by front retaining ring 10. Each of the front petals 9 form a shape similar to a frustrum of a right circular cone with a contoured surface 15 on the forward portion to give a place for retaining ring 10 to band to and hold all the petals closed. The fin protection device can have as few as two petals but three or four petals is preferred. The number of petals is a choice of design based upon the fin used and/or the necessity to have the fin protection device separate from the fins quicker. Retaining ring 10 keeps the petals in a close wrapped arrangement around the front leading edges of fin blades 3 to protect them while travelling through the propellant bed and the gun tube. After muzzle exit, retaining ring 10 is broken allowing the petals to rotate.

Figure 4:
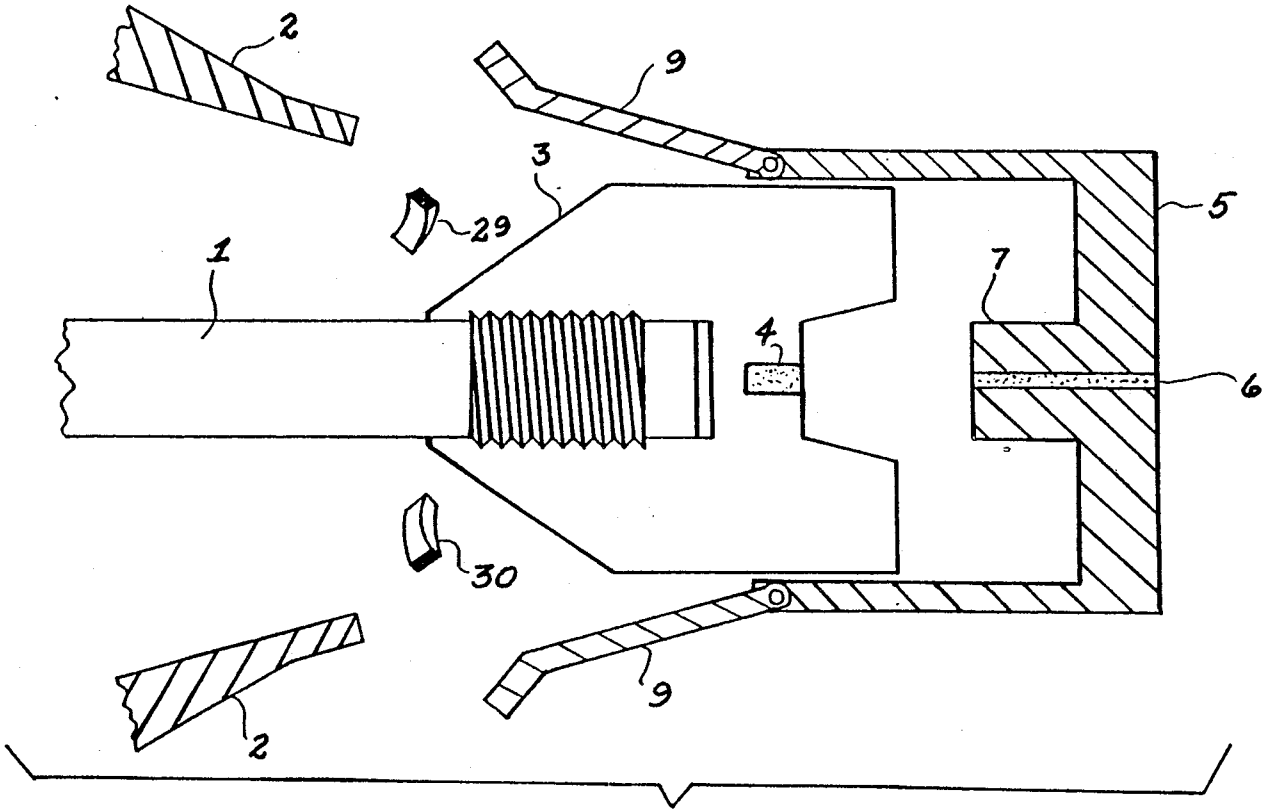
FIG. 4 is a partial cross section showing the fin protection device separating from the fin stabilized penetrator after exit from the gun barrel.

When the propellant in the cartridge is ignited, pressure is placed on base 25 forcing seat 7 to transfer the forces to the fin hub and penetrator 1. As described earlier, seat 7 can compress and distribute the forces to the fin blades as well. Protection from fracture of the blades is now provided. Powder train 21 will also ignite and will initiate tracer 4 at muzzle exit. Small gap 28 minimizes rocking caused by local differential pressure gradients or the propellant accelerating into the base wall. Side wall 24 will also distribute the forces on the outer edges of fins 3 in a somewhat uniform manner to reduce the chance of one blade absorbing all of the pressure forces. As the projectile starts to accelerate, the front petals will shield the front leading edges of the fin blades from the propellant bed, thus reducing any chance of ablation of the front leading blade edges or the ablative protection coatings on the fin blades prior to muzzle exit. As shown in FIG. 4, upon muzzle exit the retaining ring will break into separate pieces 29 and 30 allowing the front petals to rotate and clear fins 3. The aerodynamic forces will dynamically disengage the protection shell cavity from fins 3 and separate the protection shell rearwardly away from projectile 1.

In FIG. 1, petals 9 are held from opening by retaining ring 10 which is a modified rear sabot retaining ring, which normally holds the sabot petals 2 on penetrator 1. The rear sabot retaining ring in this embodiment is thus extended to maintain the front petals 9 in a closed position. Retaining ring 10 breaks due to aerodynamic forces once the projectile is out of the muzzle and separates the sabot petals. Then the front petals 9 are free to rotate about pivot point 8 by means of a leaf spring 50.

Figure 2:
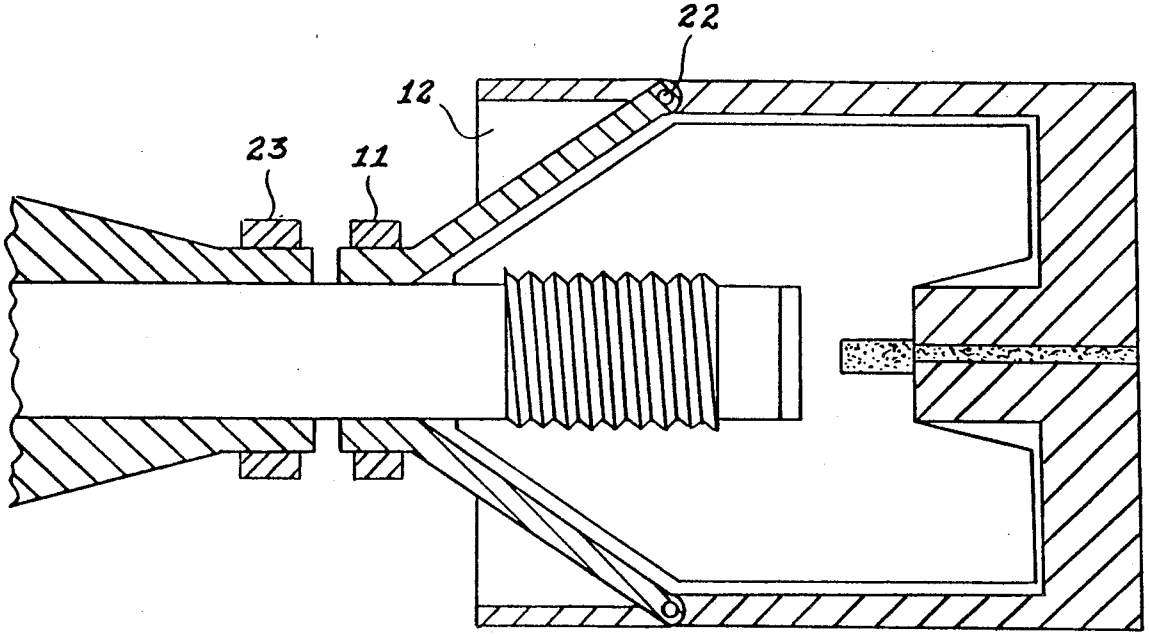
FIG. 2 is a partial cross section of a fin stabilized penetrator having its fins protected by an alternate embodiment of the present invention.

In FIG. 2, an alternate method of petal retention and opening is shown. In this embodiment, the method used to initiate rotation of petal 9 is a petal bell 12, which operates in a manner similar to that of a discarding sabbot. Either the retaining ring 10 of FIG. 1 or a separate retaining ring 11 can be used in this embodiment. The retaining ring shown is a ring which will break once enough aerodynamic force is present on petal bell 12. Retaining ring 11 can be made of plastic or metal and easily designed to have the necessary strength. Once retaining ring 11 is broken, aerodynamic forces will cause petal bell 12 to rotate front petal 9 about rotation point 22. The sabot likewise is held by a normal rear sabot retaining ring 23.

Figure 3:
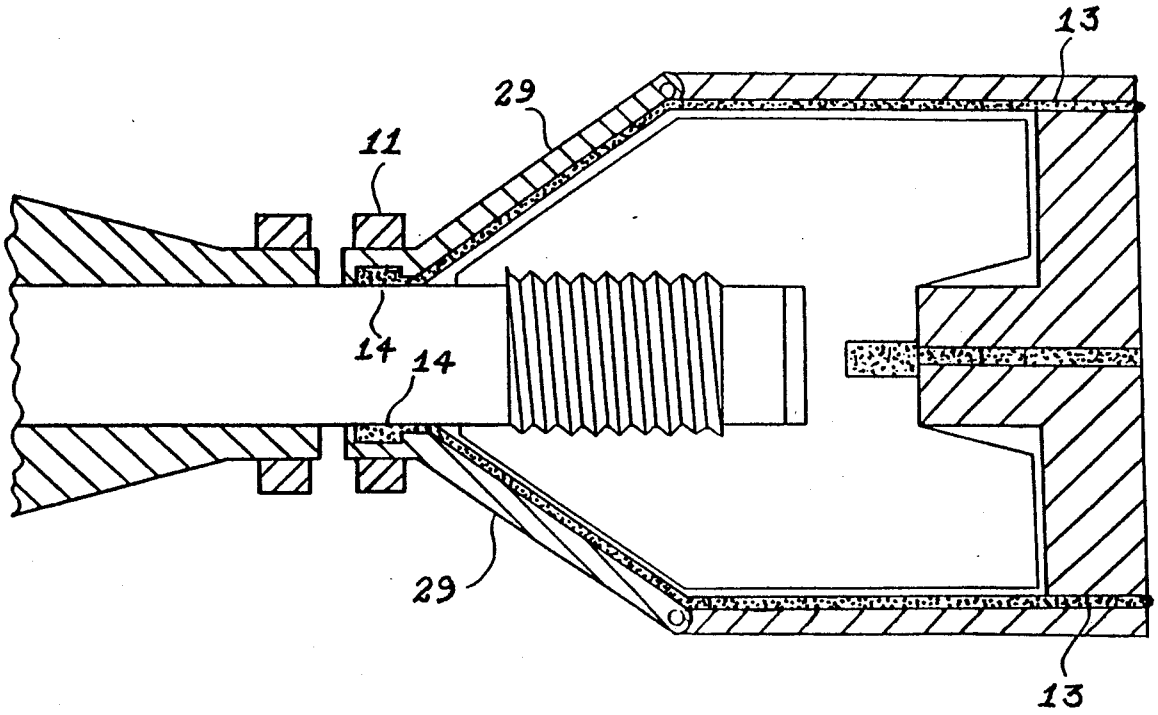
FIG. 3 is a partial cross section of a fin stabilized penetrator having its fins protected by an alternate embodiment of the present invention.

In FIG. 3, the method of holding the front petals in position is the same retaining ring 11 as FIG. 2. The method of rotating front petal 29 is an explosive circuit. The hot propellant gases ignite explosive train 13. Explosive train 13 is designed to ignite the small explosive charge 14 at muzzle exit. Explosive charge 14 produces just enough energy to break retaining ring 11 allowing front petals 9 to rotate with aid from the leaf spring 50 at pivot point 8 (as shown in FIG. 1) or a petal bell of the type shown in FIG. 2. Although only one explosive train may be necessary to ignite explosive charge 14, it is preferable to have two or more explosive trains to insure explosive charge 14 is ignited.

To those skilled in the art, many modifications and variations of the present invention are possible in light of the above teachings. It is therefore to be understood that the present invention can be practiced otherwise than as specifically described herein and still will be within the spirit and scope of the appended claims.

I claim:

1. A device for protecting fins having a hub of a projectile comprising:

a cylindrical housing having a closed base, a side wall and an open end;

said closed base having a means for transmitting a portion of the propellant forces used to launch said projectile to said fins;

said open end having pivotably attached a plurality of petal enclosures, each of said petal enclosures having the shape of a frustrum of a right circular cone and a contoured portion having a contoured surface in contact with said projectile;

means for retaining said petals in a closed position with said contoured surface against said projectile;

means for opening said petals after said projectile exits the muzzle end of a launcher.

2. The device of claim 1 wherein said means for transmitting a portion of the propellant forces used to launch said projectile to said fins is a seat for contacting the hub of said fins.

3. The device of claim 2 wherein said seat is compressible so as to distribute a portion of the propellant forces used to launch said projectile evenly among the hub and blades of said fins.

4. The device of claim 1 further comprising an aperture centrally located within said closed base, said aperture containing a powder train used to ignite a tracer located in the hub of said fins.

5. The device of claim 1 wherein said means for retaining said petals in a closed position is an extended sabot retaining ring surrounding said contoured surface of said petals.

6. The device of claim 1 wherein said means for retaining said petals in a closed position is a retaining ring located on said contoured portion of said petals.

7. The device of claim 1 wherein said means for opening said petals comprises a spring located at the pivot point of said petals.

8. The device of claim 1 wherein said means for opening said petals comprises an aerodynamic surface located on each petal so as to rotate said petals after said projectile exits the muzzle of a launcher.

9. The device of claim 8 wherein said aerodynamic surface has a bell shape.

10. A device for protecting the fins of a projectile comprising:

a cylindrical housing having a closed base, a side wall and an open end;

said closed base having a means for transmitting a portion of the propellant forces used to launch said projectile to said fins;

said open end having pivotably attached a plurality of petal enclosures, each of said petal enclosures having the shape of a frustrum of a right circular cone and a contoured portion having a contoured surface in contact with said projectile;

a retaining ring located on said contoured portion of said petals for retaining said petals in a closed position with said contoured surface against said projectile;

an explosive train ignited by the propellant of said projectile and an explosive located below each of said contoured surface of said petals for opening said petals after said projectile exits the muzzle end of a launcher;

a spring located at the pivot point of said petals to rotate said petals after opening.

11. A device for protecting the fins of a projectile comprising:

a cylindrical housing having a closed base, a side wall and an open end;

said closed base having a means for transmitting a portion of the propellant forces used to launch said projectile to said fins;

said open end having pivotably attached a plurality of petal enclosures, each of said petal enclosures having the shape of a frustrum of a right circular cone and a contoured portion having a contoured surface in contact with said projectile;

a retaining ring located on said contoured portion of said petals for retaining said petals in a closed position with said contoured surface against said projectile;

an explosive train ignited by the propellant of said projectile and an explosive located below each of said contoured surface of said petals for opening said petals after said projectile exits the muzzle end of a launcher;

an aerodynamic surface located on each petal to rotate said petals after opening.

* * * * *